US010484769B2

(12) United States Patent
Zhang

(10) Patent No.: US 10,484,769 B2
(45) Date of Patent: Nov. 19, 2019

(54) SPEAKER BOX

(71) Applicant: AAC Technologies Pte. Ltd., Singapore (SG)

(72) Inventor: Rui Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/234,786

(22) Filed: Dec. 28, 2018

(65) Prior Publication Data

US 2019/0253779 A1 Aug. 15, 2019

(30) Foreign Application Priority Data

Feb. 11, 2018 (CN) ..... 2018 1 0142845

(51) Int. Cl.
*H04R 1/02* (2006.01)
*H04R 1/28* (2006.01)
*H04R 31/00* (2006.01)

(52) U.S. Cl.
CPC ..... *H04R 1/025* (2013.01); *H04R 1/023* (2013.01); *H04R 1/288* (2013.01); *H04R 31/00* (2013.01); *H04R 2499/11* (2013.01)

(58) Field of Classification Search
CPC ..... H04R 1/025; H04R 1/023; H04R 1/288; H04R 31/00; H04R 2499/11
USPC ..... 381/334, 351, 354
See application file for complete search history.

(56) References Cited

U.S. PATENT DOCUMENTS 8,848,961 B2 * 9/2014 Huang ..... H04R 1/2807 381/351
9,838,765 B1 * 12/2017 Li ..... H04R 1/023
2008/0219490 A1 * 9/2008 Yang ..... H04R 1/2842 381/351
2009/0190783 A1 * 7/2009 Yang ..... H04R 1/28 381/337
2009/0190788 A1 * 7/2009 Yang ..... H04R 1/021 381/386
2013/0170688 A1 * 7/2013 Cohen ..... H04R 1/30 381/340
2015/0110327 A1 * 4/2015 Slotte ..... H04M 1/035 381/352
2015/0304747 A1 * 10/2015 Wang ..... H04R 5/02 381/345

(Continued)

*Primary Examiner* — David L Ton
(74) *Attorney, Agent, or Firm* — IPro, PLLC; Na Xu

(57) ABSTRACT

The present disclosure provides a speaker box, including a housing having an accommodation space, an acoustic device accommodated in the accommodation space, a first air-permeable separation component, a second air-permeable separation component. The acoustic device separates the accommodation space into a front cavity and a rear cavity. The first air-permeable separation component is fixed inside the housing and separates the rear cavity into a first rear cavity and a second rear cavity in air communication with each other. The acoustic device is located in the first rear cavity. The second rear cavity is filled with acoustic absorption particles. The second air-permeable separation component separates the second rear cavity into at least two rear sub-cavities in air communication with each other. Types of the acoustic absorption particles filled in two of the rear sub-cavities are not completely the same. Acoustic performance of the speaker box in the present disclosure is better.

10 Claims, 3 Drawing Sheets

(56) References Cited

U.S. PATENT DOCUMENTS

| | | | | |
|---|---|---|---|---|
| 2016/0261949 | A1* | 9/2016 | Liu | H04R 1/2842 |
| 2018/0255393 | A1* | 9/2018 | Wang | H04R 1/2819 |
| 2018/0302731 | A1* | 10/2018 | Liu | H04R 31/00 |

* cited by examiner

SPEAKER BOX

CROSS-REFERENCE TO RELATED APPLICATIONS

This application claims the priority benefit of Chinese Patent Applications Ser. No. 201810142845.2 filed on Feb. 11, 2018, the entire content of which is incorporated herein by reference.

TECHNICAL FIELD

The present disclosure relates to an electroacoustic apparatus, and in particular, to a speaker box.

BACKGROUND

With the advent of a mobile Internet era, the quantity of smart mobile devices constantly increases. In a plurality of mobile devices, a mobile phone is undoubtedly a most common and most portable mobile terminal device. Currently, the mobile phone has excessively various functions. One of the functions is a music function of high quality. Therefore, a speaker box configured to play sound is widely applied to the existing smart mobile devices.

The speaker box of a related technology includes a lower cover, an upper cover forming an accommodation space by being assembled with the lower cover, an acoustic device accommodated in the accommodation space, and a support wall and an air-permeable separation component that extend in a direction from the upper cover to the lower cover. The acoustic device defines a front cavity together with the upper cover. The acoustic device, the upper cover, and the lower cover jointly define a rear cavity. The air-permeable separation component is fixed to the support wall, the air-permeable separation component and the support wall together separate the rear cavity into a first rear cavity and a second rear cavity in air communication with each other, and the second rear cavity is filled with acoustic absorption particles to form a virtual acoustic cavity.

However, in the speaker box of the related technology, the second rear cavity is only a separate cavity. With a structural limit of an application terminal, the second rear cavity used by the speaker box as the virtual acoustic cavity is increasingly irregular. It is quite difficult to adjust the quantity of acoustic absorption particles required for different positions and select acoustic absorption particles of different features. Consequently, problems such as unstable performance, aggravated amplitude swing, and low temperature power particle crush generate, and finally acoustic performance of the speaker box is caused to be unreliable.

Therefore, it is desired to provide a new speaker box to resolve the foregoing technical problem.

BRIEF DESCRIPTION OF THE DRAWINGS

To illustrate the technical schemes in the embodiments of the present disclosure more clearly, the following briefly describes the accompanying drawings required for describing the embodiments. Apparently, the accompanying drawings in the following description merely show some embodiments of the present disclosure, and persons of ordinary skill in the art can derive other drawings from these accompanying drawings without creative efforts.

DETAILED DESCRIPTION

The technical solutions of the embodiments of the present disclosure are clearly and completely illustrated in the following with reference to the accompanying drawings in the embodiments of the present disclosure. Apparently, the illustrated embodiments are only some embodiments of the present disclosure, rather than all embodiments. On the basis of the embodiments of the present disclosure, all other embodiments obtained by persons of ordinary skill in the art without creative efforts shall fall within the protection scope of the present disclosure.

Figure 1:
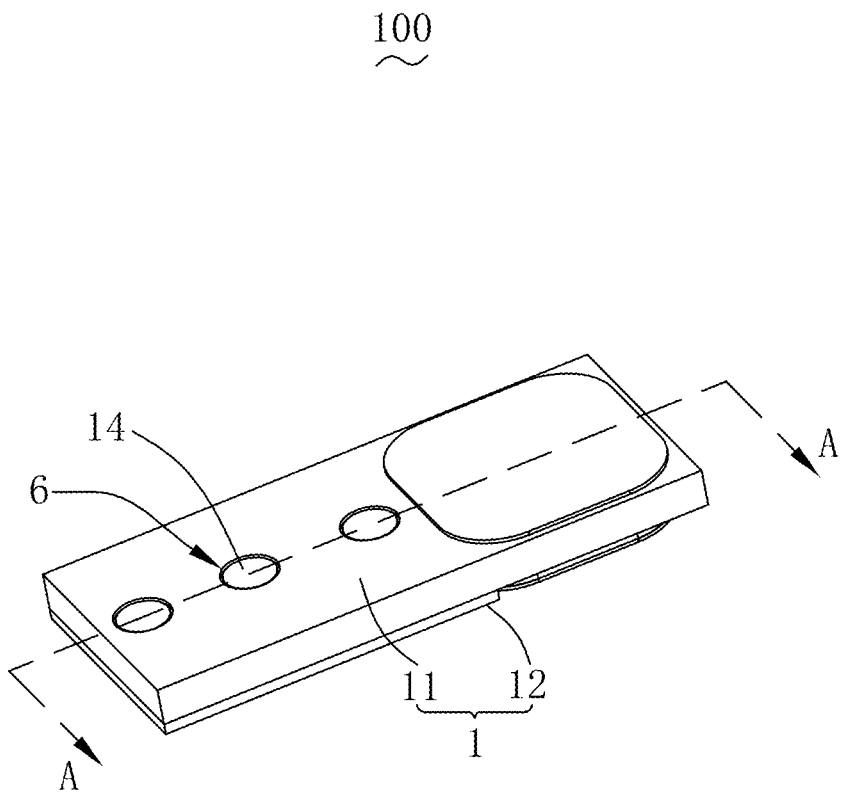
FIG. 1 is a schematic three-dimensional structural diagram of a speaker box according to the present disclosure.
Figure 2:
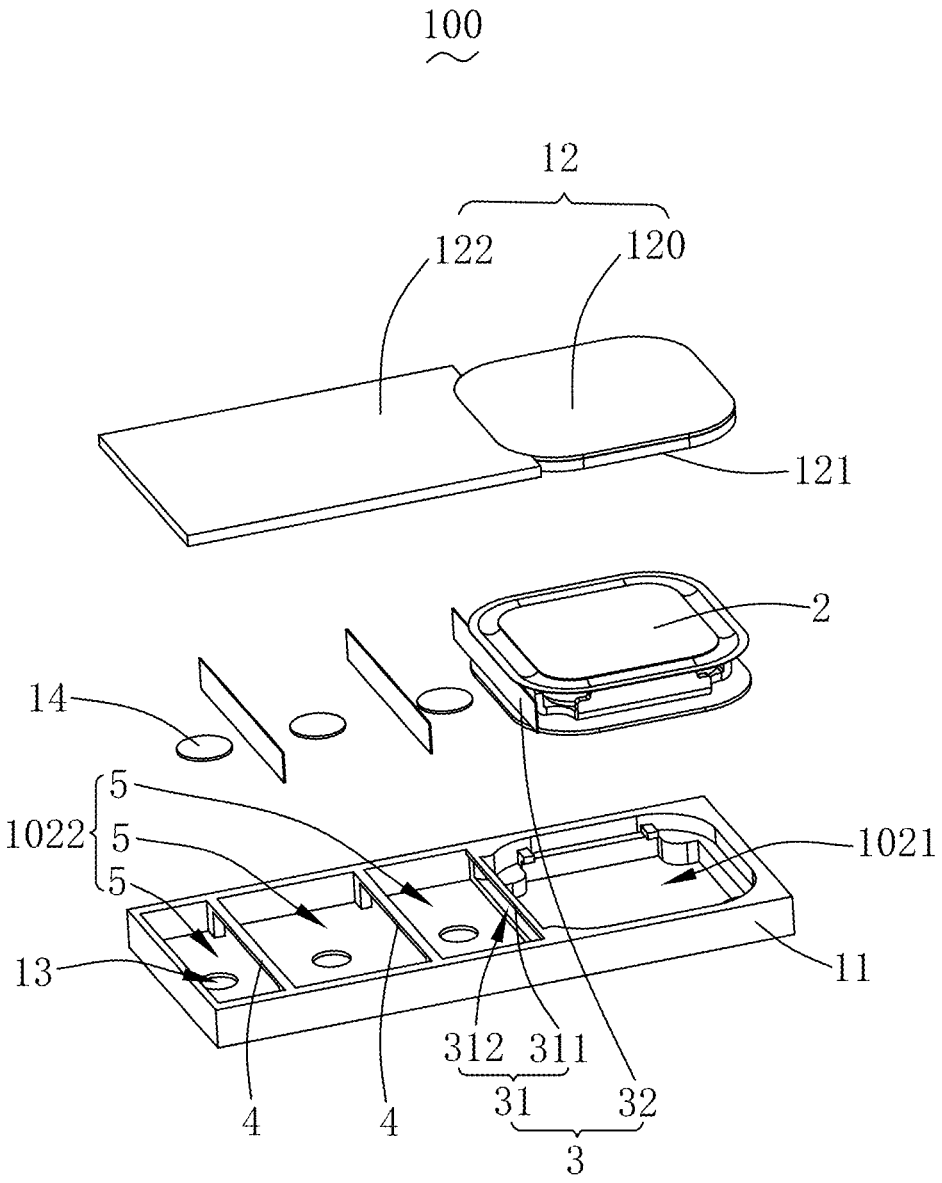
FIG. 2 is a partial three-dimensional structural exploded view of FIG. 1.
Figure 3:
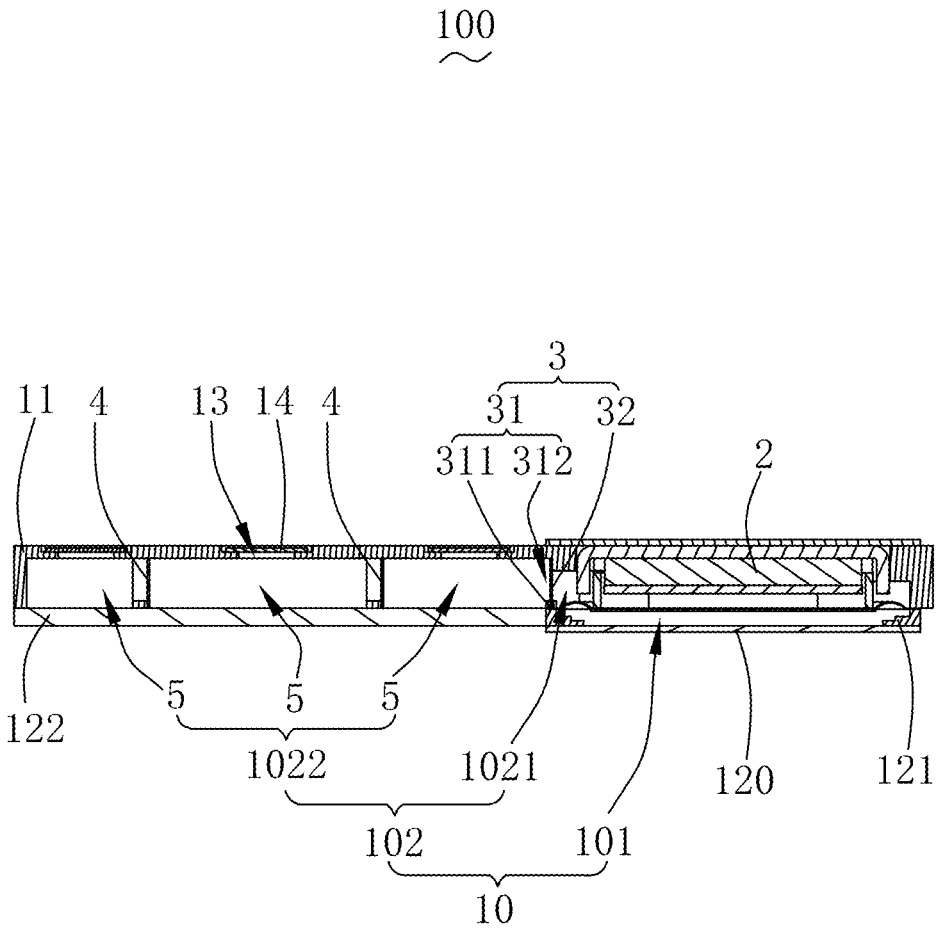
FIG. 3 is a sectional view taken along a line A-A of FIG. 1.

Refer to FIG. 1 to FIG. 3 together. The present disclosure provides a speaker box 100, including a housing 1 having an accommodation space 10, an acoustic device 2, a first air-permeable separation component 3, and a second air-permeable separation component 4.

The housing 1 includes a lower cover 11 and an upper cover 12. The lower cover 11 and the upper cover 12 are assembled together to form the accommodation space 10.

The acoustic device 2 is accommodated in the accommodation space 10. The acoustic device 2 separates the accommodation space 10 into a front cavity 101 and a rear cavity 102.

Specifically, the acoustic device 2 and the upper cover 12 are spaced away from each other and define the front cavity 101, to generate sound. The acoustic device 2, the lower cover 11, and the upper cover 12 jointly define the rear cavity 102, to improve low-frequency acoustic performance.

The first air-permeable separation component 3 is fixed inside the housing 1 and separates the rear cavity 102 into a first rear cavity 1021 and a second rear cavity 1022 in air communication with each other. In this implementation, specifically, the first air-permeable separation component 3 is fixed to the lower cover 11. Certainly, the first air-permeable separation component 3 may alternatively be fixed to the upper cover 12. Both are feasible.

The upper cover 12 includes a body 122 covering the second rear cavity 1022 and an acoustic transmission member 120 that is fixed to an edge of the body 122, covers the acoustic device 2, and is spaced apart from the acoustic device 2 to form the front cavity 101. The acoustic transmission member 120 directly faces a vibrating diaphragm of the acoustic device 2. The acoustic device 2 vibrates to generate sound and then the sound spreads outward through the acoustic transmission member 120. A washer 121 is sandwiched between an edge of the acoustic transmission member 120 and an edge of the acoustic device 2, to form the front cavity 101.

The acoustic device 2 is located in the first rear cavity 1021. The second rear cavity 1022 is filled with acoustic absorption particles (not shown) to form a D-Bass virtual acoustic cavity. The first air-permeable separation component 3 packages the acoustic absorption particles in the second rear cavity 1022 to increase a flow path of an airflow of the rear cavity 102, thereby improving the low-frequency acoustic performance of the speaker box 100.

It should be noted that in this embodiment, being in air communication with each other means that air between both can circulate with each other, but other objects do not circulate, that is, air can circulate but other objects are blocked.

The first air-permeable separation component 3 includes a frame 31 and an air-permeable separation layer 32. The frame 31 extends from the lower cover 11 and abuts against the upper cover 12. The air-permeable separation layer 32 is attached and fixed to the frame 31.

Specifically, the frame 31 includes a body 311 and a through hole 312 running through the body 311. The air-permeable separation layer 32 is attached and fixed to the body 311 and completely covers the through hole 312.

The frame 31 may be fixed to the air-permeable separation layer 32 in a manner of gluing, ultrasonic welding, or hot melting. These are all feasible. In this embodiment, the frame 31 and the air-permeable separation layer 32 are integrally injection-molded.

The air-permeable separation layer 32 is a nonwoven, a dust-free mesh, a nylon woven mesh, a metal mesh, or the like, but is not limited thereto provided that the air-permeable separation layer 32 is made from an air permeable material or in an air permeable manner, that is, an objective that air can circulate but other objects will be blocked can be achieved.

The second air-permeable separation component 4 is fixed to the housing 1 and separates the second rear cavity 1022 into at least two rear sub-cavities 5 in air communication with each other. Types of the acoustic absorption particles filled in two rear sub-cavities 5 are not completely the same. Specifically, the second air-permeable separation component 4 is fixedly disposed on the lower cover 11. Certainly, the second air-permeable separation component 4 may alternatively be fixedly disposed on the upper cover 12.

The quantity of the second air-permeable separation components 4 is at least two, and the second air-permeable separation components 4 separate the second rear cavity 1022 into at least three rear sub-cavities 5 in air communication with each other.

In this embodiment, that the quantity of the second air-permeable separation components 4 is two, as an example, for description. For example, two second air-permeable separation components 4 are parallel to each other and are spaced apart from each other, and the second rear cavity 1022 is separated into three rear sub-cavities 5 by using the two second air-permeable separation components 4.

Specifically, the second air-permeable separation component 4 has a same structure as the first air-permeable separation component 3. More preferably, the second air-permeable separation component 4 and the first air-permeable separation component 3 are parallel to each other and are spaced apart from each other. Certainly, the foregoing position relationship is not limited to be parallel to each other. The spacing and the position relationship of the second air-permeable separation component 4 may be controlled based on an actual requirement to define a volume of each rear sub-cavity 5, to be filled with different quantities and different types of acoustic absorption particles, thereby resolving different problems and requirements of the speaker box 100.

For example, to alleviate a problem of low temperature power (LTOT) particle crush, two rear sub-cavities 5 are respectively filled with low-temperature resistant and high-strength acoustic absorption particles and conventional acoustic absorption particles, thereby resolving the problem of the particle crush.

Alternatively, when several rear sub-cavities 5 are one entire cavity, when one of the rear sub-cavities 5 is relatively narrow due to a structural limit, when acoustic absorption particles is filled into the one of the rear sub-cavities 5, and when the relatively narrow rear sub-cavity 5 is excessively filled with the small acoustic absorption particles and is completely blocked, resonance frequency F0 of the speaker box is increased. However, the several rear sub-cavities 5 are separately filled. One of the rear sub-cavities 5 may be filled with large acoustic absorption particles (where equivalent acoustic compliance C is small), and the quantity of the acoustic absorption particles is small; and another one of the rear sub-cavities 5 is filled with small acoustic absorption particles (where equivalent acoustic compliance C is large), and the quantity of the acoustic absorption particles is large. In this way, an effect that one equivalent rear cavity is relatively large (where acoustic compliance C is large) and a wobble performance difference in different directions is relatively small is achieved.

When a plurality of rear sub-cavities 5 forms a multi-compartment structure, the rear sub-cavities 5 can be separately filled, avoiding a case in which a single-compartment rear cavity causes that an area cannot be filled with acoustic absorption particles due to a structural limit, and an area is filled with excessive acoustic absorption particles.

In this embodiment, a cavity is located on a side of the acoustic device. An amplitude close to a rear cavity side is greater than an amplitude away from the rear cavity side. Amplitude swing can be alleviated in various manners such as adjusting types and quantities of acoustic absorption powder of rear cavities and mesh for separating the rear cavities.

Further, the housing 1 further includes powder filling holes 13 running through the housing 1 and a cover sheet 14 covering the powder filling holes 13. For example, the powder filling holes 13 are provided on the lower cover 11. The quantity of the powder filling holes 13 matches the quantity of the rear sub-cavities 5, and each powder filling hole 13 is in communication with one rear sub-cavity 5, to separately filling acoustic absorption particles in each rear sub-cavity 5.

More preferably, a groove 6 is provided on an outer side of the lower cover 11. The powder filling holes 13 run through the groove 6. The cover sheet 14 is accommodated and fixed in the groove 6.

Compared with a related technology, the first air-permeable separation component and the second air-permeable separation component are disposed in the speaker box in the present disclosure. The first air-permeable separation component separates the rear cavity into the first rear cavity and the second rear cavity in communication with each other, and then the second air-permeable separation component separates the second rear cavity into the at least two rear sub-cavities, to form the multi-compartment second rear cavity. According to the foregoing structure, each rear sub-cavity can be separately filled with acoustic absorption particles based on a requirement. Types of the acoustic absorption particles in the rear sub-cavity may not be completely the same. The quantity of the rear sub-cavities and the types of the acoustic absorption particles are adjusted based on a requirement, so that low-frequency acoustic performance of the speaker box is better and has good reliability.

The foregoing descriptions are merely embodiments of the present disclosure, and the protection scope of the present disclosure is not limited thereto. All equivalent structure or process changes made according to the content of this specification and accompanying drawings in the present disclosure or by directly or indirectly applying the present disclosure in other related technical fields shall fall within the protection scope of the present disclosure.

What is claimed is:

1. A speaker box, comprising a housing having an accommodation space, an acoustic device accommodated in the accommodation space, and a first air-permeable separation component, wherein the acoustic device separates the accommodation space into a front cavity and a rear cavity, the first air-permeable separation component is fixed inside the housing and separates the rear cavity into a first rear cavity and a second rear cavity in air communication with each other, the acoustic device is located in the first rear cavity, the second rear cavity is filled with acoustic absorption particles, the speaker box further comprises a second air-permeable separation component fixed inside the housing, the second air-permeable separation component separates the second rear cavity into at least two rear sub-cavities in air communication with each other, and types of the acoustic absorption particles filled in two rear sub-cavities are not completely the same.

2. The speaker box according to claim 1, wherein a quantity of the second air-permeable separation components is at least two, and the second air-permeable separation components separate the second rear cavity into at least three rear sub-cavities in air communication with each other.

3. The speaker box according to claim 1, wherein the second air-permeable separation component has a same structure as the first air-permeable separation component.

4. The speaker box according to claim 3, wherein the second air-permeable separation component and the first air-permeable separation component are parallel to each other and are spaced apart from each other.

5. The speaker box according to claim 1, wherein the housing comprises a lower cover and an upper cover defining the accommodation space together with the lower cover, the acoustic device and the upper cover are spaced apart from each other and define the front cavity, the acoustic device, the lower cover, and the upper cover jointly define the rear cavity, and the first air-permeable separation component and the second air-permeable separation component both extend from the lower cover and abut against the upper cover.

6. The speaker box according to claim 5, wherein the first air-permeable separation component comprises a frame and an air-permeable separation layer, the frame is fixed to the lower cover, and the air-permeable separation layer is attached and fixed to the frame.

7. The speaker box according to claim 6, wherein the frame comprises a body and a through hole running through the body, and the air-permeable separation layer is attached and fixed to the body and completely covers the through hole.

8. The speaker box according to claim 7, wherein the frame and the air-permeable separation layer are integrally injection-molded.

9. The speaker box according to claim 6, wherein the air-permeable separation layer is a nonwoven, a dust-free mesh, a nylon woven mesh, or a metal mesh.

10. The speaker box according to claim 1, wherein the housing comprises powder filling holes running through the housing and a cover sheet covering the powder filling holes, a quantity of the powder filling holes matches a quantity of the rear sub-cavities, and each powder filling hole is in one-to-one correspondence with and is in communication with one rear sub-cavity.

* * * * *